US006549095B2

(12) United States Patent
Tsukamoto et al.

(10) Patent No.: US 6,549,095 B2
(45) Date of Patent: Apr. 15, 2003

(54) DIELECTRIC FILTER, DIELECTRIC DUPLEXER, AND COMMUNICATION APPARATUS

(75) Inventors: Hideki Tsukamoto, Omihachiman (JP); Katsuhito Kuroda, Omihachiman (JP); Jinsei Ishihara, Kanazawa (JP); Hideyuki Kato, Ishikawa-ken (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

(21) Appl. No.: 09/927,020

(22) Filed: Aug. 9, 2001

(65) Prior Publication Data

US 2002/0030558 A1 Mar. 14, 2002

Related U.S. Application Data

(62) Division of application No. 09/429,571, filed on Oct. 28, 1999.

(30) Foreign Application Priority Data

Oct. 29, 1998 (JP) ..... 10-308492
Sep. 22, 1999 (JP) ..... 11-268482

(51) Int. Cl.[7] ..... H01P 5/12; H01P 1/20
(52) U.S. Cl. ..... 333/134; 333/202; 333/206
(58) Field of Search ..... 333/202, 206, 333/134

(56) References Cited

U.S. PATENT DOCUMENTS 5,130,683 A * 7/1992 Agahi-Kesheh et al. .... 333/134
5,208,565 A * 5/1993 Sogo et al. ..... 333/206
5,696,473 A * 12/1997 Tsujiguchi et al. ..... 333/202
5,905,420 A * 5/1999 Tsujiguchi et al. ..... 333/134
6,023,207 A * 2/2000 Ito et al. ..... 333/203
6,163,237 A * 12/2000 Toda et al. ..... 333/127

FOREIGN PATENT DOCUMENTS

| | | | |
|---|---|---|---|
| DE | 199 51 298 A1 | * | 5/2000 |
| EP | 0688059 A1 | | 12/1995 |
| EP | 0817302 A2 | | 1/1998 |
| EP | 0 831 544 A1 | * | 3/1998 |
| JP | 10145109 | | 5/1998 |

OTHER PUBLICATIONS

Patent Abstracts of Japan, JP 62 043904 (Murata MFG Co., Ltd.) Feb. 25, 1987.
Patent Abstracts of Japan, JP 10 145109 (Fuji Electrochem Co., Ltd.) May 29, 1998.

* cited by examiner

*Primary Examiner*—Patricia Nguyen
(74) *Attorney, Agent, or Firm*—Dickstein, Shapiro, Morin & Oshinsky, LLP.

(57) ABSTRACT

The invention provides a dielectric filter, comprising: a dielectric block having a first end face and a second end face and side faces extending therebetween; a plurality of resonator holes and at least one external coupling hole respectively passing through both end faces; inner conductors provided on inner faces of the resonator holes and the external coupling holes; an external conductor provided on the outer faces of the dielectric block; concavities provided in formation regions of the external coupling holes on the first and the second end face and in the short-circuiting regions of the resonator holes; and the external conductor being removed except from the portions of the concavities in the first end face and the second end face, thereby forming open faces of the resonator holes on the first end face and the second end face.

13 Claims, 8 Drawing Sheets

DIELECTRIC FILTER, DIELECTRIC DUPLEXER, AND COMMUNICATION APPARATUS

CROSS REFERENCE TO RELATED APPLICATION

This is a divisional of U.S. patent application Ser. No. 09/429,571, filed Oct. 28, 1999 in the name of Hideki TSUKAMOTO, et al. and entitled "DIELECTRIC FILTER, DIELECTRIC DUPLEXER, AND COMMUNICATION DEVICE", now abandoned.

BACKGROUND OF THE INVENTION

1. Field of the Invention

The present invention relates to a dielectric filter, used for instance in a microwave band, a dielectric duplexer, and a communication apparatus using these.

2. Description of the Related Art

For instance, FIG. 11 shows a structure of this type of conventional dielectric filter. In the following diagrams, shaded portions represent portions where the bare outside of the dielectric block (nonconductive portions) can be seen.

This dielectric filter comprises resonator holes 2*a* and 2*b*, and external coupling holes 3*a* and 3*b*, provided from a first end face 1*a* of a dielectric block 1 passing to a second end face 1*b* opposite thereto, inner conductors being provided on the inner faces of these holes, and an external conductor 6 being provided on the outer face of the dielectric block 1. Unformed portions of the external conductor 6 (nonconductive portions) are provided at the opening regions of the resonator holes 2*a* and 2*b* in the first end face 1*a*, and the inner conductors of the resonator holes 2*a* and 2*b* are isolated from the external conductor 6 by the first end face 1*a*, but lead to the external conductor 6 on the second end face 1*b*. Furthermore, the external conductor 6 is provided at the opening regions of the external coupling holes 3*a* and 3*b* in the first end face 1*a*, and the inner conductors in the external coupling holes 3*a* and 3*b* lead to the external conductor 6 at the first end face 1*a*. Furthermore, input/output electrodes 7*a* and 7*b* are isolated from the external conductor 6, and are provided across the second end face 1*b* and one side face, leading to the inner conductors of the external coupling holes 3*a* and 3*b*. In this constitution, the inner conductors of the resonator holes 2*a* and 2*b* are combline-coupled, the inner conductors of the external coupling holes 3*a* and 3*b* are interdigitally coupled to their respective adjacent resonator holes 2*a* and 2*b*, and this electromagnetic field coupling achieves an external coupling.

In this way, when one side face of a dielectric block is deemed the open terminal of inner conductors in the resonator holes, and in addition, an external coupling is obtained using external coupling holes, external conductor formed regions and unformed regions are needed on one side face. This dielectric filter is manufactured by using nonelectrolytic plating to provide an electrode material on all the outer faces of the dielectric block, comprising resonator holes and external coupling holes, and in all the inner faces of the holes; thereafter, the external conductor at the opening region of the resonator holes on the first side face, and the external conductor around the input/output electrode are removed. This removal of the resonator holes opening region of the first side face is performed by removing the external conductors using sandpaper or the like.

Furthermore, when the open face of one resonator hole of adjacent resonator holes is provided at a first end face, the open face of the other resonator hole is provided at a second end face, and the adjacent resonator holes are interdigitally coupled, external conductor formed regions and unformed regions are needed on both end faces.

However, in the above described prior art dielectric filter, since the external conductors at the opening regions of the resonator holes must be partially removed, and open faces forming the open terminals of the inner conductors of the resonator holes must be provided, there is a problem that the formation operation of the open faces of the resonator holes is difficult, increasing manufacturing costs.

Furthermore, there are problems such as difficult in precisely forming the above open faces, causing variation in the filter characteristics.

On the other hand, the external conductors may be formed on the end faces by a screen printing method, but in this case, the number of manufacturing processes such as conductor paste printing, conductor heating, and the like, is increased, and furthermore, there is a problem that positional deviation, wrinkling of the conductor paste, and the like, will adversely affect the positional precision of the external conductors.

SUMMARY OF THE INVENTION

To overcome the above described problems, preferred embodiments of the present invention provide a dielectric filter, a dielectric duplexer, and a communication apparatus using these, wherein open faces of resonator holes can be formed by a simple operation and with high dimensional precision, and which are consequently inexpensive and have superior characteristics.

One preferred embodiment of the present invention provides a dielectric filter or a dielectric duplexer, comprising: a dielectric block having a first end face and a second end face and side faces extending therebetween; a plurality of resonator holes and at least one external coupling hole respectively passing through both end faces; inner conductors provided on inner faces of the resonator holes and the external coupling holes; an external conductor provided on the outer faces of the dielectric block; concavities provided in formation regions of the external coupling holes on the first and the second end face and in the short-circuiting regions of the resonator holes; and the external conductor being removed except from the portions of the concavities in the first end face and the second end face, thereby forming open faces of the resonator holes on the first end face and the second end face.

That is, the open faces of the resonator holes on the side faces, which form the opening faces of the resonator holes, protrude further than the other portions.

According to the above described structure and arrangement, by a simple operation of polishing the opening faces of the resonator holes on the first end face and the second end face, it is possible to remove the external conductor on the entire outer faces of the resonator holes on the first end face and the second end face. That is, the external conductor in the concavities in the first end face and the second end face is not removed, whereby the external conductor can be provided easily and with high precision on the formation regions of the external coupling holes on the first end face and the second end face, and on the short-circuiting faces of the resonator holes, making it possible to obtain superior filter characteristics.

Furthermore, in a structure wherein the open faces of all the resonator holes are provided on the first end face, the concavities are provided in the formation regions of the external coupling holes on the first end face, and the external conductor is removed except from the portions of the concavities in the first end face, thereby forming open faces of the resonator holes on the first end face.

According to the above described structure and arrangement, by the simple operation of polishing the opening faces of the resonator holes on the first end face, it is possible to remove the external conductor from all the outer faces of the resonator holes on the first end face, enabling the open faces of the resonator holes to be provided on the first end face with high precision.

Furthermore, the dielectric filter and the dielectric duplexer according to a preferred embodiment of the present invention comprise external coupling adjustment holes, passing through the concavities in the external coupling holes formation region on the first end face and the second end face, and inner conductors are provided on the inner faces thereof. In this case, the opening portions of the external coupling holes in the concavities, and the opening faces of the external coupling adjustment holes, may be provided at different positions along the axial directions of the holes.

In the above described structure and arrangement, the size of the external coupling can be adjusted by changing the shape of the diameter and the arrangement position of the external coupling holes and the external coupling adjustment holes. Furthermore, the external coupling adjustment holes have a function of cutting off couplings between adjacent resonator holes on either side thereof. Moreover, by changing the shape and depth of the concavities, and changing the length (axial length) of the external coupling holes and the external coupling adjustment holes, it is possible to increase the freedom with which the size of the external coupling can be adjusted and set.

Furthermore, an even greater external coupling can be obtained by connecting input/output electrodes to the inner conductors in the external coupling holes on the second end face, the input/output electrodes being isolated from the external conductor, and interdigitally coupling the inner conductors in the external coupling holes to the inner conductors in adjacent resonator holes. Furthermore, if the input/output electrodes are provided crossing to a side face, the side face on which the input/output electrodes are provided can be a surface mount face.

A constitution is acceptable wherein external coupling means comprising external coupling holes is applied to at least one input/output portion of multiple input and output portions, and the external coupling of the other input/output portions is achieved by the capacitance coupling of the input/output electrodes to the external coupling holes. Furthermore, the input/output electrodes may be connected to the inner conductors in the external coupling holes on the first end face, and isolated from the external conductor, and the inner conductors of the external coupling holes and the inner conductors in the resonator holes adjacent thereto can be combline coupled. Furthermore, the inner conductors of the external coupling holes can be isolated from the external conductor on one end face, without providing input/output electrodes, and metallic input/output terminals which connect to the inner conductors of the external coupling holes can then be inserted.

Furthermore, a communication apparatus according to the present invention comprises the dielectric filter and the dielectric duplexer having the features described above, and therefore, it is inexpensive and has superior characteristics.

Other features and advantages of the present invention will become apparent from the following description of the invention which refers to the accompanying drawings.

DESCRIPTION OF THE PREFERRED EMBODIMENTS

Figure 1:
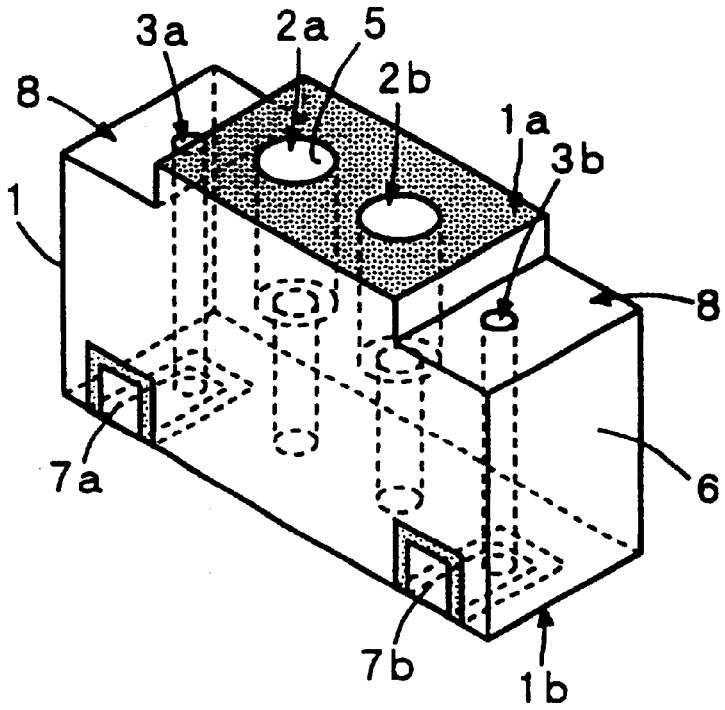
FIG. 1 is a perspective view of a dielectric filter according to a first embodiment.

A dielectric filter according to a first preferred embodiment of the present invention will be explained with reference to FIG. 1. FIG. 1 is a perspective view of a dielectric filter, and shows open faces of resonator holes at the top, and a mount face to a circuit substrate at the front.

The dielectric filter of the present embodiment comprises holes and electrodes of predetermined shapes provided on a substantially rectangular dielectric block 1, comprising a dielectric ceramic. Resonator holes 2*a* and 2*b*, and external coupling holes 3*a* and 3*b* are provided passing through from a first end face 1*a* of the dielectric block 1 to a second end face 1*b* opposite thereto, so that their axes are parallel to each other, and concavities 8 are provided at the formation regions of the external coupling holes 3*a* and 3*b* on the first end face 1*a*. The concavities 8 are positioned on both sides of the first end face 1*a,* and are formed by notching rectangular shapes in the three side faces. The diameters of the resonator holes 2*a* and 2*b* are large one the first end face 1*a* side, and small on the second end face 1*b,* forming step holes. The diameters of the external coupling holes 3*a* and 3*b* are the same along their entire lengths, forming straight holes.

Inner conductors 5 are provided in the holes 2*a,* 2*b,* 3*a,* and 3*b*. An external conductor 6 is provided substantially over the entire outer faces of the dielectric block, with the exception of the open faces of the resonator holes 2*a* and 2*b* on the first end face 1*a,* and input/output electrodes 7*a* and 7*b* are provided at the openings of the external coupling holes 3*a* and 3*b* on the second end face 1*b,* and are isolated from the external conductor 6. The input/output electrodes 7*a* and 7*b* are provided across the second end face 1*b* and the side face, and the side face of this dielectric filter on which the input/output electrodes 7*a* and 7*b* are provided is the mount face, which is mounted on a mount substrate.

The inner conductors 5 of the resonator holes 2*a* and 2*b* are isolated from the external conductor 6 on the first end face 1*a,* and connect to the external conductor 6 on the second end face 1*b;* the opening faces of the resonator holes 2*a* and 2*b* on the first end face 1*a* being the open faces of the resonator holes 2*a* and 2*b,* and the second end face 1*b* being the short-circuiting face of the resonator holes. That is, on the first end face 1*a,* the open faces of the resonator holes 2*a* and 2*b* are provided at a position projecting out from the other portions.

The inner conductors 5 of the external coupling holes 3*a* and 3*b* are connected to the external conductor 6 on the first end face 1*a* (in the concavities 8), and are connected to the input/output electrodes 7*a* and 7*b* on the second end face 1*b,* while being isolated from the external conductor 6. That is, the external coupling holes 3*a* and 3*b* are short-circuited on the first end face 1*a*.

This dielectric filter comprises two resonators in correspondence with the inner conductors 5 in the resonator holes 2*a* and 2*b,* these adjacent resonators being combline coupled, and the inner conductors 5 in the external coupling holes 3*a* and 3*b* are interdigitally coupled by an electromagnetic field to the inner conductors 5 of the adjacent resonator holes 2*a* and 2*b,* thereby obtaining by this coupling an external coupling.

Next, the manufacturing method of the dielectric filter of the present embodiment will be explained.

Figure 2:
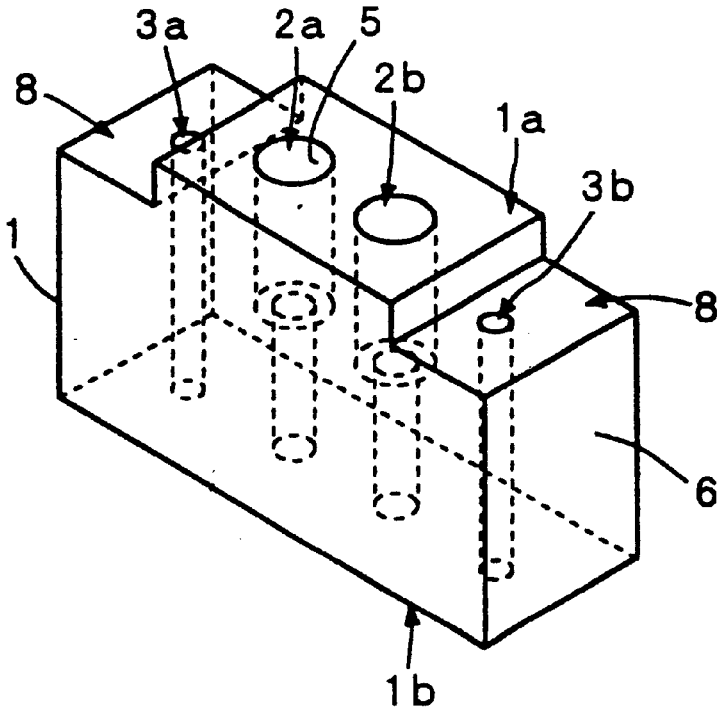
FIG. 2 is a perspective view of a manufacturing process of the dielectric filter according to the first embodiment, showing a state when conductors are provided to all faces of a dielectric block.

A substantially rectangular dielectric block having resonator holes and external coupling holes, with concavities provided in opening regions of the external coupling holes in one face where the holes are open (first side face), is formed by press forming, and this is heated to obtain a dielectric block 1. Next, electrode material, such as Cu and Ag, is provided by nonelectrolytic plating on all surfaces of a dielectric block, and as shown in FIG. 2, inner conductors are provided in the inner faces of the holes 2*a,* 2*b,* 3*a,* and 3*b,* and an external conductor 6 is provided on all the outer faces, forming the dielectric block 1. Next, the first end face 1*a* is flat-polished by a rotating polisher, sandpaper, or the like, removing the external conductor 6 except from the concavities 8. Next, the external conductor 6 around the input/output electrodes 7*a* and 7*b* is removed by an ultrasonic processing machine, forming input/output electrodes 7*a* and 7*b* which are isolated from the external conductor 6, thereby obtaining the dielectric filter shown in FIG. 1. The formation of the concavities 8 may acceptably be performed by cutting after forming and heating the dielectric block.

The depth of the concavities 8 need only be the depth left by the external conductor 6 when the first end face 1*a* has been flat-polished; furthermore, the shape of the concavities 8 is not restricted to that shown in the above embodiment. Furthermore, the two concavities 8 do not have to be the same shape.

In the present embodiment, the resonator holes are step holes, and the external coupling holes are straight holes, but the resonator holes may be straight holes, and the external coupling holes may be step holes, it being acceptable to mix straight holes and step holes. Furthermore, although the present embodiment describes a dielectric filter having a two-stage constitution, the dielectric filter may acceptably comprise three or more resonators with three or more resonator holes provided in the dielectric block. In this case, the external coupling holes are provided adjacent to the resonator holes in the input/output stage.

As described above, in the dielectric filter of the present embodiment, since the concavities 8 are provided at opening regions of the external coupling holes 3*a* and 3*b* on the first end face 1*a,* by the simple operation of polishing the first end face 1*a* until it is flat, it is possible to leave the external conductor 6 on the concavities 8 forming the openings of the external coupling holes 3*a* and 3*b,* while in addition removing the external conductor from all the open faces of the resonator holes 2*a* and 2*b*. That is, the open faces of the resonator holes 2*a* and 2*b* can be provided inexpensively, and in addition, the dimensions of the formation regions and unformed regions of the external conductor 6 (nonconductive portions 6) on the first end face 1*a* are highly precise, enabling variation in filter characteristics caused by variation in the shape of the external conductor 6 to be greatly reduced.

By changing the shape and depth of the concavities 8, changing the length (axial length) of the external coupling holes 3*a* and 3*b,* the size of the external coupling can also be adjusted and set.

Figure 3:
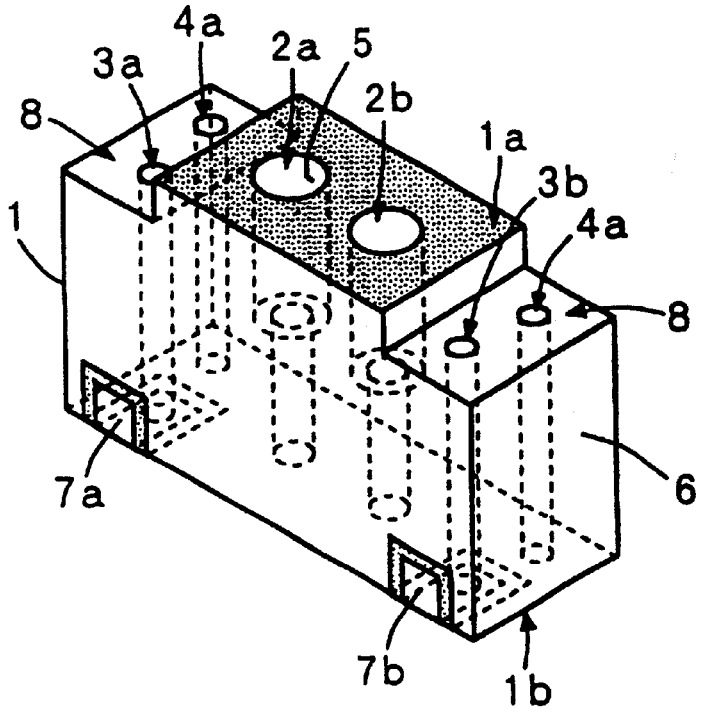
FIG. 3 is a perspective view of a dielectric filter according to a second embodiment.

Next, FIG. 3 shows a constitution of a dielectric filter according to a second embodiment of the present invention. In the example of the first embodiment, only the external coupling holes were provided in the concavities of the first side face, but in the present embodiment, in addition to the external coupling holes 3*a* and 3*b,* external coupling adjustment holes 4*a* to 4*c* are provided passing through the concavities 8 and the second end face 1*b,* and having inner conductors 5 provided on their inner faces. The inner conductors 5 of the external coupling adjustment holes 4*a* and 4*b* connect (lead) to the external conductor 6 on both end faces 1*a* and 1*b*. The rest of the constitution is the same as in the first embodiment, and explanation thereof will be omitted. The external coupling adjustment holes 4*a* and 4*b* are provided to adjust the external coupling (to weaken the external coupling), and can obtain various external couplings by changing the formation position and shape of the external coupling adjustment holes 4*a* and 4*b*.

In this constitution, merely by flat-polishing the first end face 1*a* and leaving the external conductor 6 in the concavities 8, the open faces of the resonator holes 2*a* and 2*b* can be provided with high precision and simply. Furthermore, the external coupling can be adjusted and set by changing the shape and depth of the concavities 8.

Figure 4:
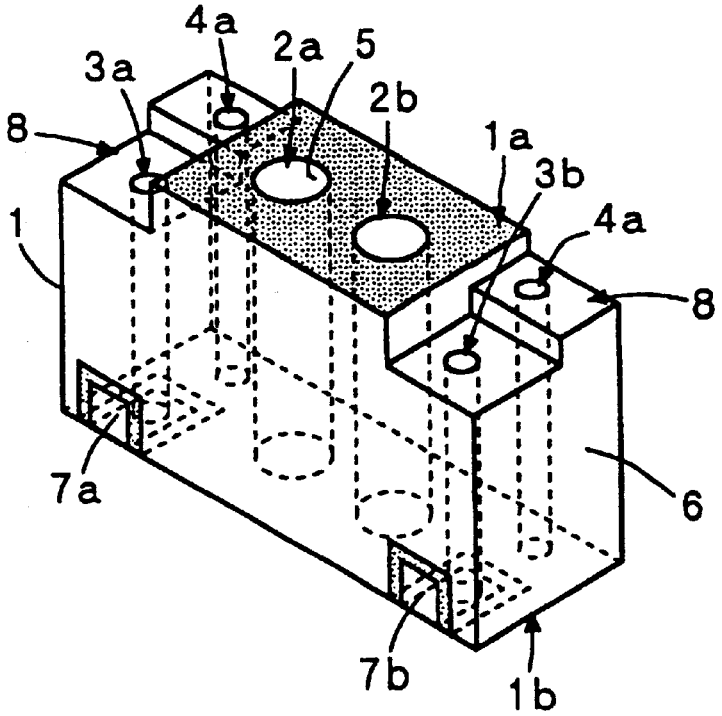
FIG. 4 is a perspective view of a dielectric filter according to a third embodiment.

FIG. 4 shows a constitution of a dielectric filter according to a third embodiment of the present invention. In the present embodiment, the concavities 8 are provided in a step shape, being deep on one side face side and shallow on the other side face side, the external coupling holes 3*a* and 3*b* are provided in the deep parts of the concavities, and the external coupling adjustment holes 4*a* and 4*b* are provided in the shallow parts. That is, the openings of the external coupling holes 3*a* and 3*b* and the external coupling adjustment holes 4*a* and 4*b* are provided in different positions in the axial length direction. By differing the axial length of the external coupling holes and the external coupling adjustment holes in this way, in addition to the effects described in the second embodiment above, the adjusting and setting of the external coupling can be performed more freely, and more varied external couplings can be obtained.

Figure 5:
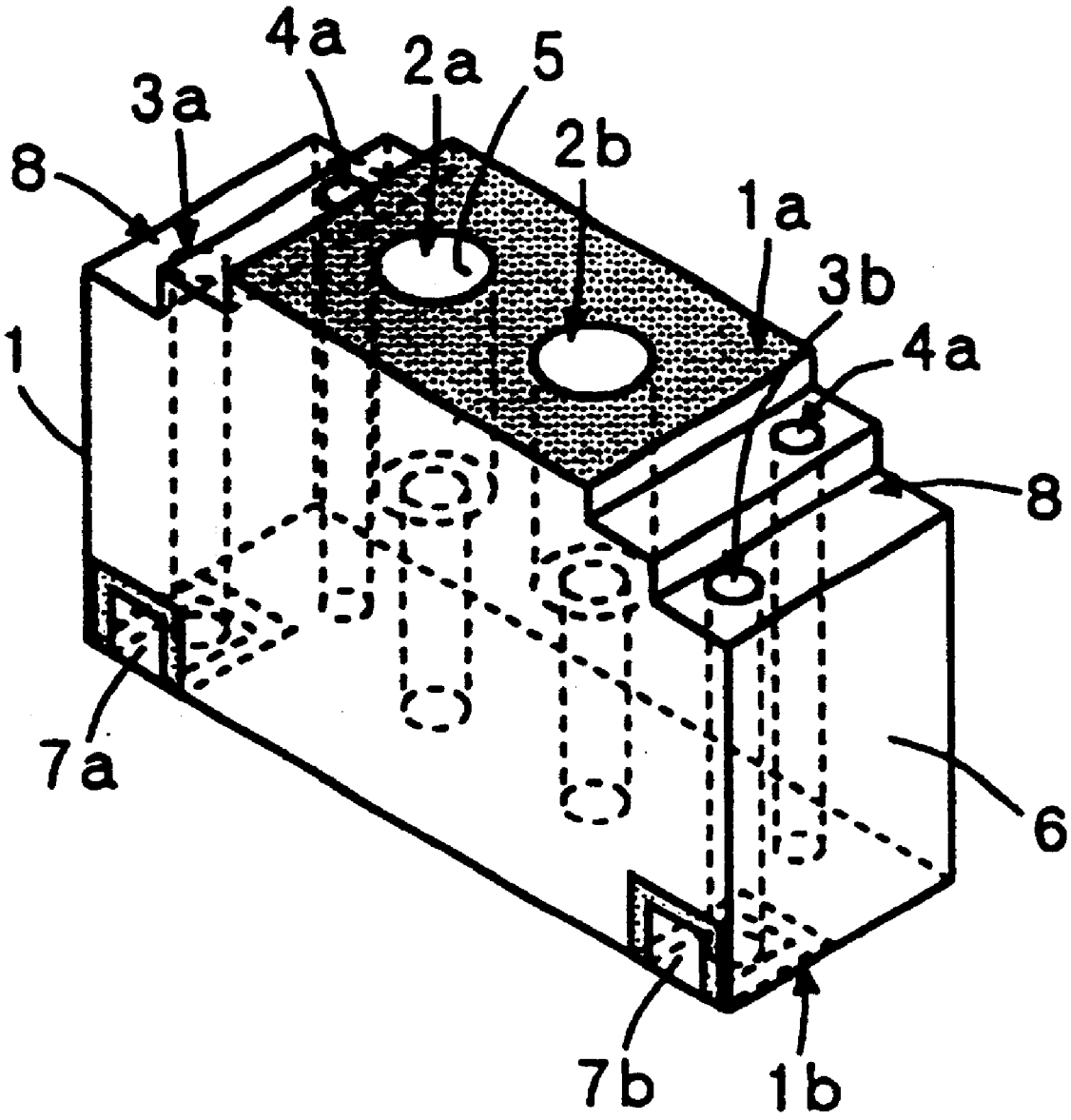
FIG. 5 is a perspective view of a dielectric filter according to a fourth embodiment.

FIG. 5 shows a dielectric filter according to a fourth embodiment of the present invention. In the present embodiment, the concavities 8 are provided in a step shape, being shallow on the resonator holes 2*a* and 2*b* side and deep on the side face sides, the external coupling holes 3*a* and 3*b* are provided in the deep parts of the concavities, and the external coupling adjustment holes 4*a* and 4*b* are provided in the shallow parts. This constitution achieves the same effects as the third embodiment.

Figure 6:
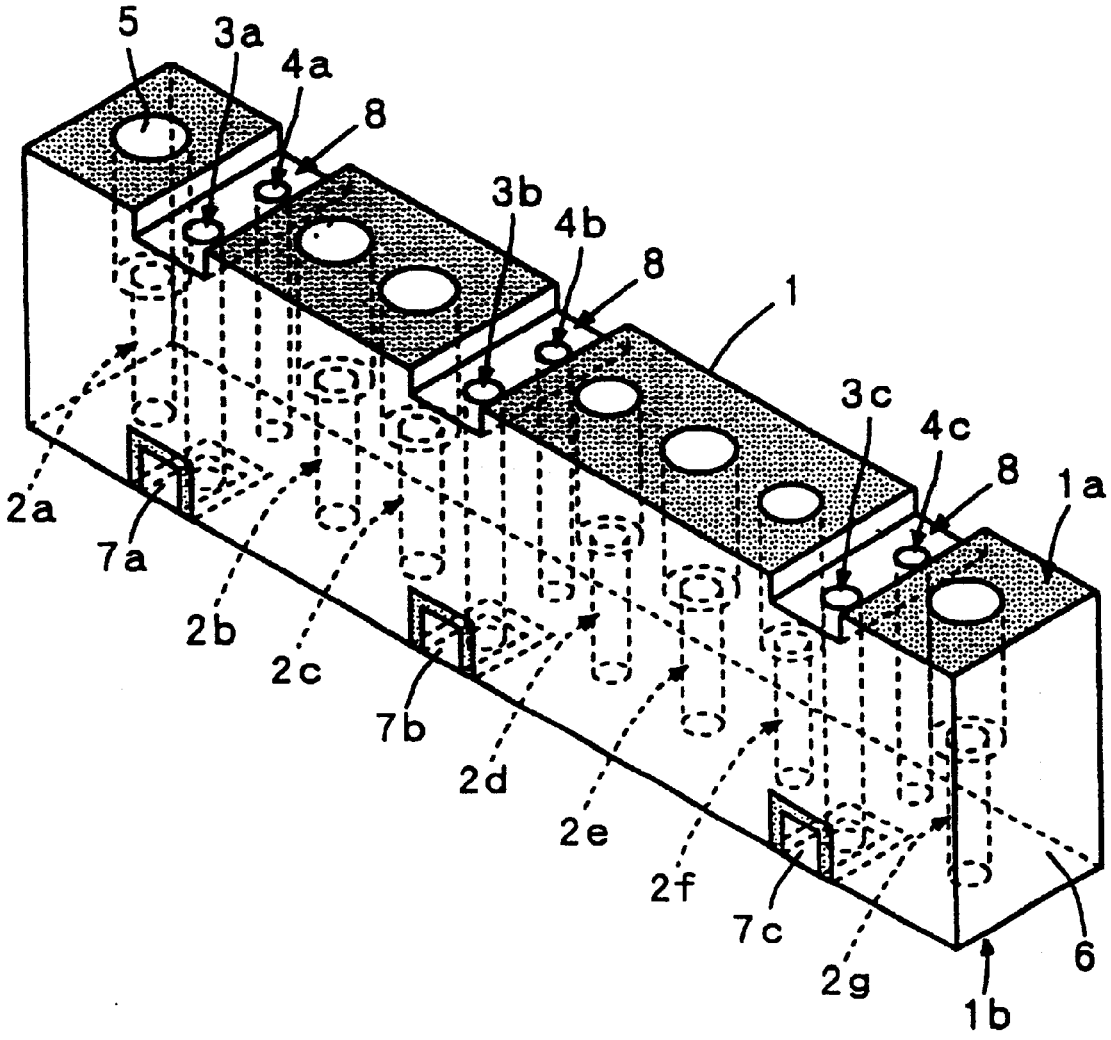
FIG. 6 is a perspective view of a dielectric duplexer according to a fifth embodiment.

Next, FIG. 6 shows a dielectric duplexer (antenna resonator) according to a fifth embodiment of the present invention. The dielectric duplexer of the present embodiment comprises a substantially rectangular dielectric block 1, the transmission side comprising a bandpass filter, comprising two-stage resonators in correspondence with the resonator holes 2*b* and 2*c,* and a trap resonator in correspondence with the resonator hole 2*a,* and the reception side comprising a bandpass filter, comprising three-stage resonators in correspondence with the resonator holes 2*d* to 2*f,* and a trap resonator in correspondence with the resonator hole 2*g*. The concavities 8 are provided on the first end face 1*a* of the dielectric block 1 between the resonator holes 2*a* and 2*b,* between the resonator holes 2*c* and 2*d,* and between the resonator holes 2*f* and 2*g,* and external coupling holes 3*a,* 3*b,* and 3*c,* and external coupling adjustment holes 4*a,* 4*b*, and 4*c,* are provided in the regions of the concavities 8. In the present embodiment, the concavities 8 are provided in groove-shapes along opposing side faces.

Inner conductors 5 are provided on the inner faces of the holes 2*a* to 2*g*, 3*a,* 3*b,* 3*c,* 4*a,* 4*b,* and 4*c*. An external conductor 6 is provided substantially over all the outer faces of the dielectric block, with the exception of the open faces of the resonator holes 2*a* to 2*g* on the first end face 1*a*. The input/output electrodes 7*a,* 7*b,* and 7*c* are provided across the second end face 1*b* and the side faces, and connect to the inner conductors 5 in the external coupling holes 3*a,* 3*b,* and 3*c,* and are isolated from the external conductor 6.

The input/output electrode 7*a* functions as the transmission terminal of a transmission side filter, the input/output electrode 7*c* functions as the receive terminal of a transmission side filter, and the input/output electrode 7*b* functions as an antenna terminal sharing the input and output of the transmission and receive filters. The external coupling hole 3*a* is interdigitally coupled to the adjacent resonator holes 2*a* and 2*b,* the external coupling hole 3*b* is interdigitally coupled to the adjacent resonator holes 2*c* and 2*d,* and the external coupling hole 3*c* is interdigitally coupled to the adjacent resonator holes 2*f* and 2*g,* and these couplings obtain the external coupling. In addition to the function of adjusting the external coupling, the external coupling holes 3*a* to 3*c* of the present embodiment also have a function of cutting off couplings between the adjacent resonator holes on either side thereof.

In this constitution, the concavities 8 are provided in the first end face 1*a*, enabling the same effects to be achieved as were described in the first and second embodiments.

It is also acceptable to provide trap resonators on either side of the external coupling holes, as in the present embodiment, in the dielectric filters of the first to fourth embodiments.

Figure 7:
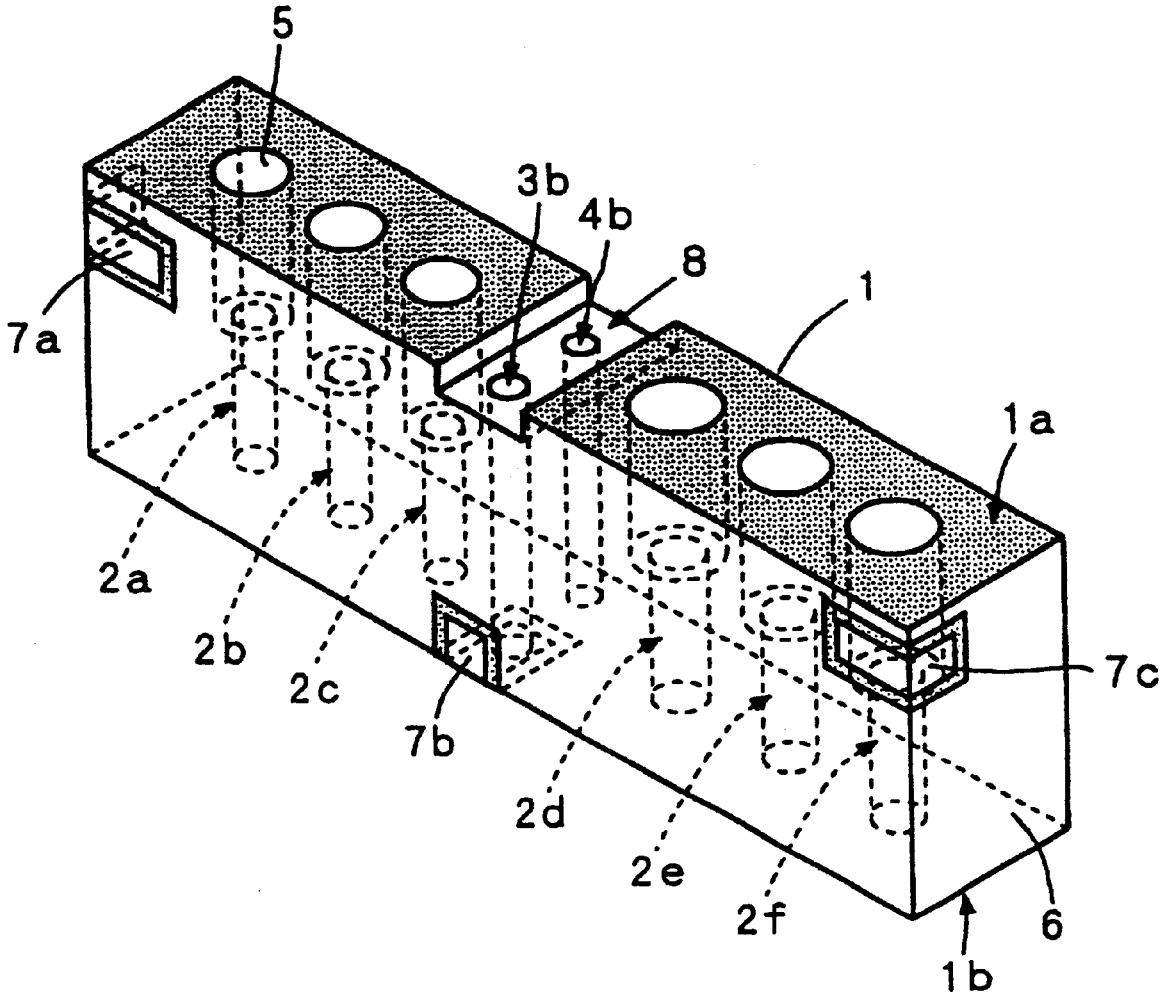
FIG. 7 is a perspective view of a dielectric duplexer according to a sixth embodiment.

Next, FIG. 7 shows a constitution of a dielectric duplexer according to a sixth embodiment of the present invention. The dielectric duplexer of the present embodiment comprises a substantially rectangular dielectric block 1, the transmission side comprising a bandpass filter, comprising three-stage resonators in correspondence with the resonator holes 2*a,* 2*b,* and 2*c,* and the reception side comprising a bandpass filter, comprising three-stage resonators in correspondence with the resonator holes 2*d* to 2*f*. The concavities 8 are provided on the first end face 1*a* of the dielectric block 1 between the resonator holes 2*c* and 2*d,* and an external coupling hole 3*b* and an external coupling adjustment hole 4*b* are provided in the regions of the concavities 8. Inner conductors 5 are provided on the inner faces of the holes 2*a* to 2*f,* 3*b,* and 4*b*. The external conductor 6 is provided on substantially all faces of the dielectric block 1, excluding the open faces of the holes 2*a* to 2*f* on the first end face 1*a*.

The input/output electrode 7*b* which forms the antenna terminal is provided across the second end face 1*b* and the side face, and the input/output electrode 7*a* which forms the transmission terminal, and the input/output electrode 7*c* which forms the receive terminal, are provided near the first end face 1*a* across to the adjacent side faces. The input/output electrodes 7*a* and 7*c* are capacitance-coupled to the resonator holes 2*a* and 2*f* respectively, these capacitances achieving an external coupling. The external coupling hole 3*b* is interdigitally coupled to the adjacent resonator holes 2*c* and 2*d,* and this coupling achieves an external coupling. In this way, external coupling means comprising external coupling holes may be applied to one input/output portion of multiple input and output portions, and in this case, only one concavity needs to be provided in the first end face.

In this constitution, the concavity is provided in the first end face 1*a*, enabling the same effects to be achieved as were described in the first and second embodiments.

In the constitution of the fifth and sixth embodiments, the concavities may be provided with a step portion as in the third and fourth embodiments. Furthermore, the external coupling adjustment holes do not necessarily have to be provided.

Furthermore, in the embodiments described above, the coupling between the external coupling holes and the resonator holes of the input/output stage is an interdigital coupling in order to obtain an even greater external coupling, but it is acceptable to provide the input/output electrodes in the concavities in the first end face and achieve the external coupling by a combline coupling.

In the embodiments described above, the open faces of the resonator holes were all provided on the first end face, and adjacent resonators were combline coupled, but next, the constitutions of a dielectric filter and a dielectric duplexer in which adjacent resonators are interdigitally coupled will be explained with reference to FIG. 8 and FIG. 9.

Figure 8:
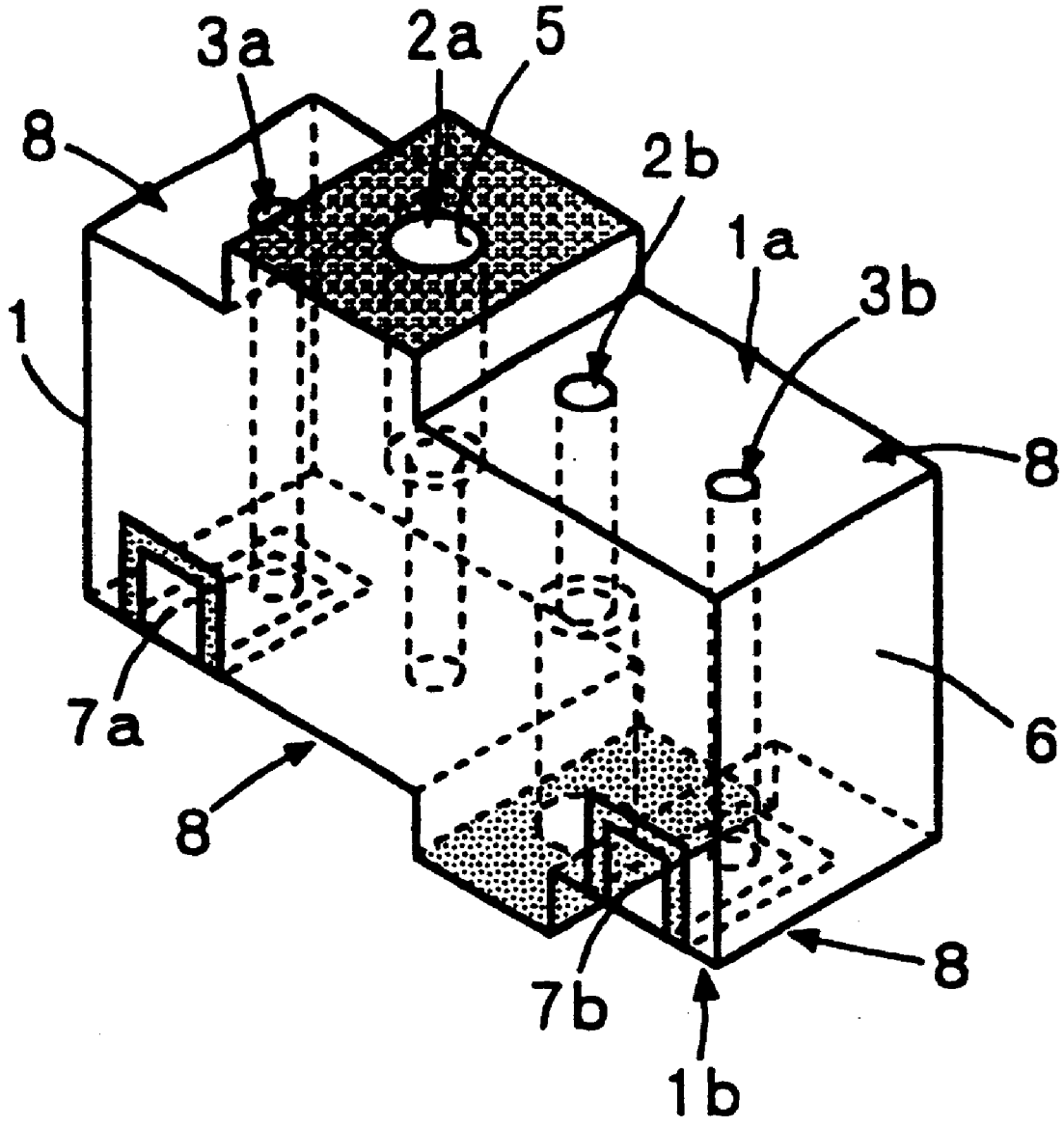
FIG. 8 is a perspective view of a dielectric filter according to a seventh embodiment.

FIG. 8 shows a constitution of a dielectric filter according to a seventh embodiment of the present invention. The dielectric filter of the present embodiment comprises concavities 8 provided in the formation regions of the external coupling holes 3*a* and 3*b,* and the short-circuiting region of the resonator hole 2*b* on the first end face 1*a,* and furthermore, in the formation regions of the external coupling holes 3*a* and 3*b,* and the short-circuiting region of the resonator hole 2*a* on the second end face 1*b*. The opening face of the resonator hole 2*a* on the first end face 1*a,* and the opening face of the resonator hole 2*b* on the second end face 1*b,* are unformed conductor portions (nonconductive portions), and these faces form the open faces of the resonator holes 2*a* and 2*b*. That is, the open face of the resonator hole 2*a* on the first end face 1*a,* and the open face of the resonator hole 2*b* on the second end face 1*b,* are provided in positions projecting further than other portions. The resonator holes 2*a* and 2*b* are interdigitally coupled.

Figure 9:
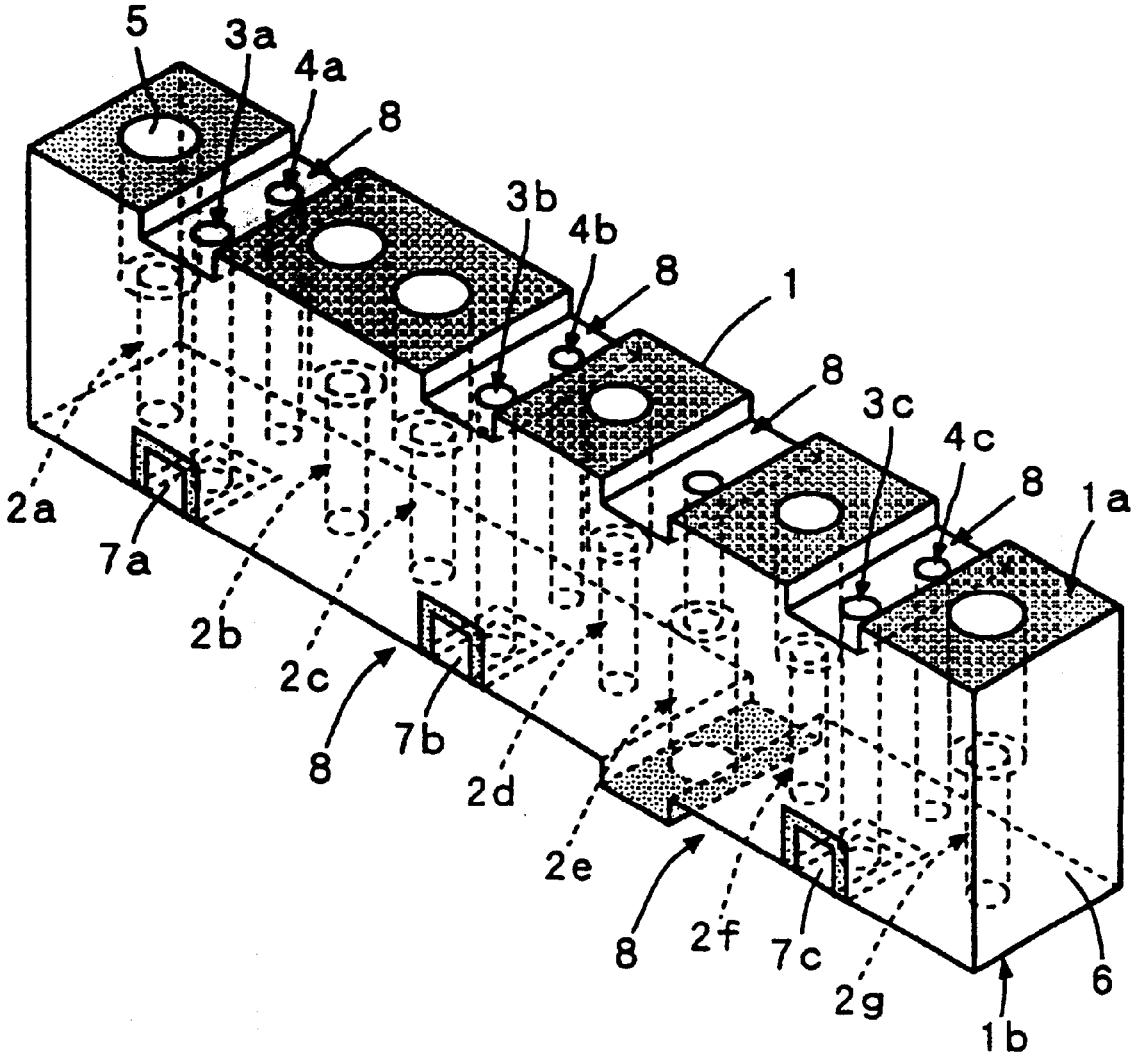
FIG. 9 is a perspective view of a dielectric duplexer according to an eighth embodiment.

FIG. 9 shows a constitution of a dielectric duplexer according to an eighth embodiment of the present invention. In the dielectric duplexer of the present embodiment, the open face of one resonator hole 2*e,* comprising a reception side filter, is provided on the second end face 1*b*. The concavities 8 are provided in portions excluding the formation regions of the external coupling holes 3*a* to 3*c* and the external coupling adjustment holes 4*a* to 4*c* on the first end face 1*a,* the short-circuiting region of the resonator hole 2*e,* and also the open region of the resonator 2*e* on the second end face 1*b*. The opening faces of the resonator holes 2*a* to 2*d,* 2*f,* and 2*g* on the first end face 1*a,* and the opening face of the resonator hole 2*e* on the second end face 1*b,* are unformed conductor portions (nonconductive portions), and these faces form the open faces of the resonator holes. That is, the open faces of the resonator holes 2*a* to 2*d,* 2*f,* and 2*g* on the first end face 1*a,* and the open face of the resonator hole 2*e* on the second end face, are provided in positions projecting further than the other portions. In other respects, the constitution is substantially the same as that shown in FIG. 6. The resonator holes 2*b* and 2*c* of the transmission side filter are combline-coupled, and the resonator holes 2*d,* 2*e,* and 2*f* of the reception side filter are interdigitally coupled.

In constitutions where open faces of adjacent resonator holes are on opposite end faces, as in the seventh embodiment and the eighth embodiment described above, by polishing the first end face and the second end face, the open faces of the resonator holes can be easily provided with high precision.

In each of the embodiments described above, the cross-sectional shape of the holes is not restricted to a circular shape; the holes may be square or other shapes, or a mixture of holes of these shapes may be provided.

Furthermore, the holes may be substantially straight, having the same diameter along their axial lengths, or they may be step holes, having a portion of large diameter and a portion of small diameter; and in the case of step holes, the step position can be provided in various predetermined positions.

Figure 10:
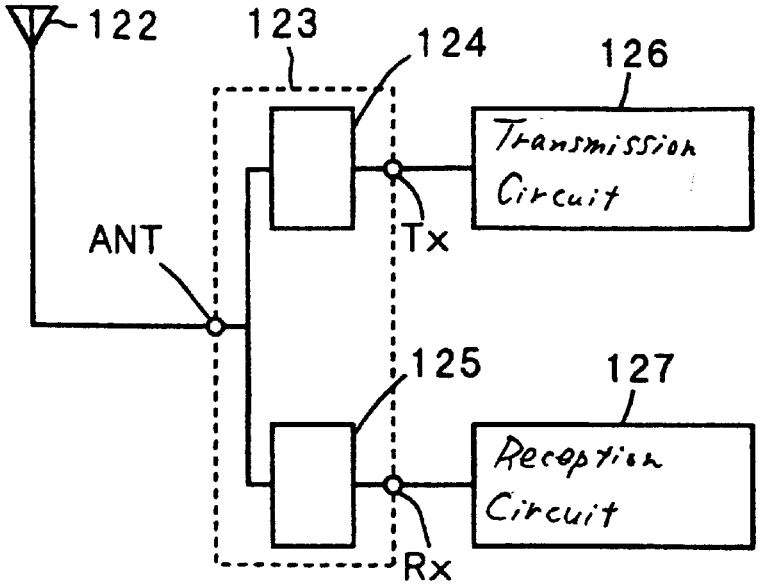
FIG. 10 is a block diagram of a communication apparatus according to a ninth embodiment.
Figure 11:
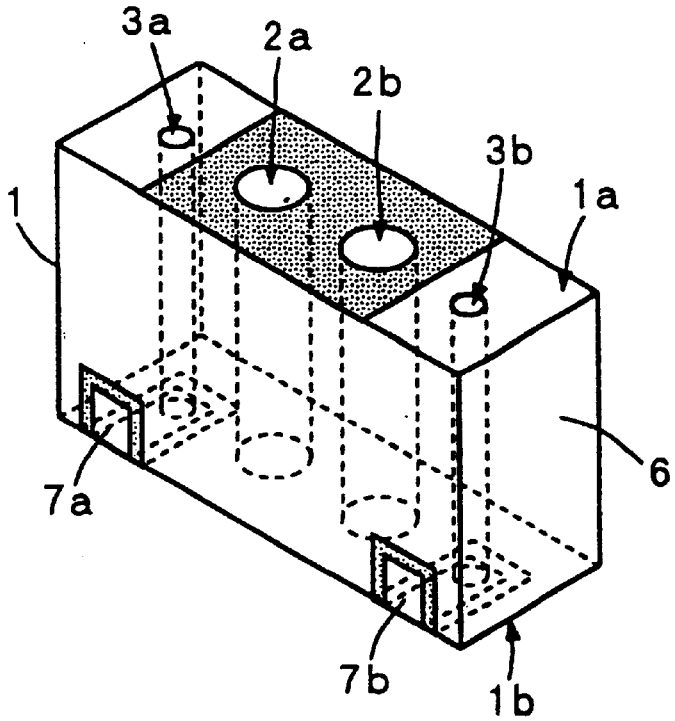
FIG. 11 Prior Art
FIG. 11 is a perspective view of a prior art dielectric filter.

Next, FIG. 10 shows a constitution of a communication apparatus according to a ninth embodiment of the present invention. In FIG. 10, 122 is an antenna, 123 is a dielectric duplexer, 124 is a transmission filter, 125 is a receive filter, 126 is a transmission circuit, and 127 is a receive circuit. The antenna terminal ANT of the dielectric duplexer 123 is connected to the antenna 122, the transmission terminal Tx is connected to the transmission circuit 126, and the receive terminal RX is connected to the receive circuit 127, forming the communication apparatus.

Here, the dielectric filter of the embodiments 1 to 4, or 7, can be used as the transmission filter 124 and the receive filter 125; furthermore, the dielectric duplexer of the embodiments 5, 6, or 8, can be used as the dielectric duplexer 123. By using the dielectric filter and the dielectric duplexer according to the present invention, a communication apparatus which is inexpensive and has superior characteristics can be realized.

As explained above, the dielectric filter and the dielectric duplexer according to the present invention comprise concavities, provided in formation regions of external coupling holes and external coupling adjustment holes, and short-circuiting regions of resonator holes, in a first end face and a second end face of a dielectric block, and by a simple operation of polishing the opening faces of the resonator holes in the first end face and the second end face, the external conductors provided over the entire faces of the opening faces of the resonator holes in the first end face and the second end face can be removed, while excluding the external conductors inside the concavities, thereby enabling the open faces of the resonator holes to be easily provided with high precision in the first end face and the second end face. Therefore, the number of processes for forming the open faces of the resonator holes in the first end face and the second end face can be greatly reduced, manufacturing costs can be reduced, and excellent characteristics can be obtained.

Moreover, by changing the shape and depth of the concavities, the freedom of adjusting and setting the size of the external coupling can be further increased, enabling desired characteristics to be easily obtained.

Furthermore, a surface mount type can easily be achieved by connecting input/output electrodes to the inner conductors in the external coupling holes. By interdigitally coupling the external coupling holes to the resonator holes of the input/output stage, a greater external coupling can be achieved, and the adjusting and setting range of the external coupling can be increased.

Furthermore, by mounting the dielectric filter and the dielectric duplexer of the present invention, a communication apparatus which is inexpensive and has superior characteristics can be obtained.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter, comprising:

a dielectric block having a first end face and a second end face and side faces extending therebetween;

a plurality of resonator holes and at least one external coupling hole respectively passing through both end faces;

inner conductors provided on inner faces of the resonator holes and the external coupling holes;

an external conductor provided on the outer faces of the dielectric block;

concavities provided in formation regions of the external coupling holes on the first end face; and the external conductor being removed except from portions of concavities in the first end face, thereby forming open circuit faces of the resonator holes on the first end face.

2. The dielectric filter according to claim 1, wherein external coupling adjustment holes are provided so as to pass through the concavities in the external coupling holes formation regions on the first end face and the second end face, respectively, and inner conductors are provided on inner faces of the external coupling adjustment holes.

3. A dielectric filter, comprising:

a dielectric block having a first end face and a second end face and side faces extending therebetween;

a plurality of resonator holes and at least one external coupling hole respectively passing through both end faces;

inner conductors provided on inner faces of the resonator holes and the external coupling holes;

an external conductor provided on the outer faces of the dielectric block;

concavities provided in formation regions of the external coupling holes on the first and the second end faces and in short-circuiting regions of the resonator holes; and the external conductor being removed except from portions of concavities in the first end face and the second end face, thereby forming open circuit faces of the resonator holes on the first end face and the second end face, respectively.

4. The dielectric filter according to claim 3, wherein external coupling adjustment holes are provided so as to pass through the concavities in the external coupling holes formation regions on the first end face and the second end face, respectively, and inner conductors are provided on inner faces of the external coupling adjustment holes.

5. The dielectric filter according to claim 4, wherein the opening portions of the external coupling holes in the concavities, and the opening portions of the external coupling adjustment holes, are provided at different positions along the axial directions of each hole.

6. The dielectric filter according to one of claims 3, 1, 4, 5 and 2, wherein an input/output electrode is provided at least on the second end face, electrically connected to the inner conductors in the external coupling holes, and is isolated from the external conductor.

7. A dielectric duplexer comprising at least two filter portions provided in a dielectric block, at least one of the filter portions being the dielectric filter according to one of claims 3, 1, 4, 5 and 2.

8. A dielectric duplexer comprising at least two filter portions provided in a dielectric block, at least one of the filter portions being the dielectric filter according to claim 6.

9. A communication apparatus comprising the dielectric duplexer according to claim 8, further comprising at least one of a transmitting circuit and a receiving circuit connected to said dielectric filter.

10. A communication apparatus comprising the dielectric duplexer according to claim 7, further comprising at least one of a transmitting circuit and a receiving circuit connected to said dielectric filter.

11. A communication apparatus comprising the dielectric filter according to one of claims 3, 1, 4, 5 and 2, further comprising at least one of a transmitting circuit and a receiving circuit connected to said dielectric filter.

12. A communication apparatus comprising the dielectric filter according to claim 6, further comprising at least one of a transmitting circuit and a receiving circuit connected to said dielectric filter.

13. The dielectric filter according to claim 6, wherein said input/output electrode is provided further on a side face of said dielectric block.

* * * * *